US008955891B2

(12) United States Patent
Millsap

(10) Patent No.: US 8,955,891 B2
(45) Date of Patent: Feb. 17, 2015

(54) DOOR STOP

(71) Applicant: Michael R. Millsap, Mililani, HI (US)

(72) Inventor: Michael R. Millsap, Mililani, HI (US)

( * ) Notice: Subject to any disclaimer, the term of this patent is extended or adjusted under 35 U.S.C. 154(b) by 0 days.

(21) Appl. No.: 13/762,747

(22) Filed: Feb. 8, 2013

(65) Prior Publication Data

US 2014/0225385 A1 Aug. 14, 2014

(51) Int. Cl.

| | |
|---|---|
| ***E05C 19/18*** | (2006.01) |
| ***E05C 17/00*** | (2006.01) |
| *E05C 17/56* | (2006.01) |
| *E05C 19/16* | (2006.01) |
| *E05F 5/00* | (2006.01) |
| *E05F 5/06* | (2006.01) |
| *E05F 5/02* | (2006.01) |
| *E05B 47/00* | (2006.01) |

(52) U.S. Cl.

CPC ..... *E05C 17/025* (2013.01); *E05B 47/0038* (2013.01); *Y10S 292/15* (2013.01); *Y10S 292/17* (2013.01)

USPC ..... 292/288; 292/251.5; 292/338; 292/339; 292/342; 292/343; 292/DIG. 15; 292/DIG. 17; 16/82; 16/86 R

(58) Field of Classification Search

CPC ..... Y10S 292/17; Y10S 16/17; E05C 17/54; E05C 17/025; E05C 19/004; E05C 17/60; E05C 19/182; E05C 17/00

USPC ..... 292/288, 338, 339, 342, 343, DIG. 17; 16/86 R, 82

See application file for complete search history.

(56) References Cited

U.S. PATENT DOCUMENTS

| | | | | |
|---|---|---|---|---|
| 2,970,857 | A | | 2/1961 | Squire |
| 3,421,461 | A | | 1/1969 | St.Clair et al. |
| 3,701,557 | A | | 10/1972 | Centofante |
| 3,791,687 | A | | 2/1974 | Schroeder |
| 3,934,909 | A | | 1/1976 | Van Natter |
| 4,155,576 | A | | 5/1979 | Kennon |
| 4,434,524 | A | | 3/1984 | Gilchrist |
| 4,648,152 | A | * | 3/1987 | Grewall ..... 16/82 |
| 4,995,655 | A | | 2/1991 | Freeman |
| 5,027,471 | A | * | 7/1991 | Barnes ..... 16/86 R |
| 5,044,681 | A | | 9/1991 | Neighbors |
| 5,509,235 | A | * | 4/1996 | Chander ..... 49/383 |
| 5,511,837 | A | * | 4/1996 | Dempsey et al. ..... 292/288 |
| 5,560,080 | A | * | 10/1996 | Reed ..... 16/82 |
| 5,581,844 | A | * | 12/1996 | Raheb et al. ..... 16/82 |
| 5,881,431 | A | * | 3/1999 | Pieper et al. ..... 16/82 |

(Continued)

FOREIGN PATENT DOCUMENTS

| | | | |
|---|---|---|---|
| WO | WO 0144609 | A1 | 6/2001 |
| WO | WO2006068945 | A1 | 6/2006 |

*Primary Examiner* — Kristina Fulton

*Assistant Examiner* — Faria Ahmad

(74) *Attorney, Agent, or Firm* — JP Webb; Jason P. Webb; Danny Y. H. Cheng

(57) ABSTRACT

There is a door stop including a block having a top surface and a bottom surface. The block includes an engaging perimeter and a non-engaging perimeter opposite the engaging perimeter and is disposed between the top surface and the bottom surface. The block includes a protrusion extending therefrom at a boundary region between the engaging perimeter and the non-engaging perimeter. The door stop includes a plurality of magnets disposed in an array along an exterior of the engaging perimeter. The door stop includes a recessed portion disposed about the engaging perimeter and is configured to rest about a hinge of a door.

13 Claims, 4 Drawing Sheets

(56) References Cited

U.S. PATENT DOCUMENTS

| | | | | |
|---|---|---|---|---|
| 6,588,811 | B1 | 7/2003 | Ferguson | |
| 7,393,027 | B1 | 7/2008 | Chen | |
| D603,694 | S * | 11/2009 | Bushey | D8/402 |
| 7,904,992 | B2 | 3/2011 | Agster et al. | |
| 8,458,958 | B2 * | 6/2013 | Cress | 49/462 |
| 8,727,404 | B2 * | 5/2014 | Martin | 292/341.14 |
| 2003/0057711 | A1 | 3/2003 | Laporta | |
| 2005/0050681 | A1 * | 3/2005 | Schlitter | 16/82 |
| 2006/0032017 | A1 * | 2/2006 | Agster et al. | 16/86 R |
| 2007/0126248 | A1 * | 6/2007 | Mintz | 292/342 |
| 2007/0245518 | A1 | 10/2007 | Blair | |
| 2008/0277949 | A1 * | 11/2008 | Emde et al. | 292/343 |
| 2009/0255085 | A1 | 10/2009 | Lorenzati | |
| 2010/0018003 | A1 | 1/2010 | Swartz et al. | |
| 2012/0248797 | A1 * | 10/2012 | Caliguri et al. | 292/251.5 |

* cited by examiner

DOOR STOP

BACKGROUND OF THE INVENTION

1. Field of the Invention

The present invention relates to door stops, specifically to a door stop configured to hold a door in an open position.

2. Description of the Related Art

A doorstop, or a door stopper or a door stop, is an object or device used to hold a door open or closed, or to prevent a door from opening too widely. Alternatively, a doorstop can be a thin slat built inside a door frame to prevent a door from swinging through when closed.

A door may be stopped by a door stop which is simply a heavy solid object, such as a rubber, placed in the path of the door. These stops are predominantly improvised. Historically, lead bricks have been popular choices when available. However, as the toxic nature of lead has been revealed, this use has been strongly discouraged.

Another method is to use a door stop which is a small wedge of wood, rubber, plastic, cotton or another material. Manufactured wedges of these materials are commonly available. The wedge is kicked into position and the downward force of the door, now jammed upwards onto the doorstop, provides enough static friction to keep it motionless.

Another strategy is to equip the door itself with a stopping mechanism. In this case, a short metal bar capped with rubber, or another high friction material, is attached to a hinge near the bottom of the door opposite the door hinge and on the side of the door which is in the direction that it closes. When the door is to be kept open, the bar is swung down so that the rubber end touches the floor. In this configuration, further movement of the door towards being closed increases the force on the rubber end, thereby increasing the frictional force which opposes the movement. When the door is to be closed, the stop is released by pushing the door slightly more open which releases the stop and allows it to be flipped upwards. A newer version of equipping the door with the stopping mechanism is to attach a magnet to the bottom of the door on the side which opens outward which then latches onto another magnet or magnetic material on the wall or a small hub on the floor. The magnet must be strong enough to hold the weight of the door, but weak enough to be easily detached from the wall or hub.

Some improvements have been made in the field. Examples of references related to the present invention are described below in their own words, and the supporting teachings of each reference are incorporated by reference herein:

U.S. Pat. No. 5,581,844, issued to Raheb et al., discloses an improved doorstop comprising a block member. A structure is for securing in a removable manner the block member against a leaf of a hinge on a doorjamb, so as to stop a door from closing completely into the doorjamb and preventing fingers of a hand of a person getting caught and damaged between an edge of the door and the doorjamb.

U.S. Pat. No. 5,044,681, issued to Neighbors, discloses a door stop arrangement is directed between a door frame and a door for positioning upon a hinge to effect maintaining the door in an opened configuration. The door stop includes a "V" shaped body defined by a joinder line, with the "V" shaped body including an "L" shaped handle extending rearwardly of the body bisecting an acute included angle between the plates defining the body to permit positioning of the "L" shaped handle overlying the hinge when the plates are directed between the door and door frame.

U.S. Pat. No. 7,904,992, issued to Agster et al., discloses a door stop device comprising a block member, a receiving channel to facilitate placement of the device onto a door hinge, and an attaching means suitable for removably attaching the door stop device to an item of clothing worn by a user. The door prop device of the present invention is designed to be readily accessible and available for immediate use by those who primarily work in, or provide service to, the resort, hotel and motel industries.

U.S. Patent Publication No.: 2012/0248797, by Caliguri et al., discloses a portable door propping apparatus includes a first arm, a second arm, and a coupling member. The first arm is pivotally coupled with the second arm. The portable door propping apparatus can be hung on a door hinge, to facilitate propping of the door in an opened position. Methods are also provided.

U.S. Patent Publication No.: 2005/0050681, by Schlitter, discloses a magnetic doorstop comprising a magnet to be placed on or near the metal surface of an interleaving knuckle of a door hinge, said magnetic doorstop preferably being shaped in the same arc or other contour as the knuckle, or having another suitable configuration, so as to be held by the magnet in the desired position. As the door to which the hinge is attached opens, the magnetic doorstop will prevent the door from opening beyond the point at which the doorstop comes into contact with the opening door, or with any part of the doorframe, doorjamb or hinge leaves.

The inventions heretofore known suffer from a number of disadvantages which include being limited in use, being difficult to use, being non-magnetic, being difficult to hold in place, being complex to use, being damaging to the door, being expensive, being ineffective, being inefficient, being bulky, requiring the user to bend over to use, failing to keep a door open, slipping/sliding/shifting during use, being bulky, having sharp/jagged/pointed protrusions, not being versatile, being weak, catching on clothing or other items when not in use, and not having a compact mode for storage.

What is needed is a door stop that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available door stops. Accordingly, the present invention has been developed to provide a safe and efficient door stop.

According to one embodiment of the invention, there is a door stop which may include a block. The block may include a top surface and a bottom surface. The block may include an engaging perimeter that may be substantially orthogonal to each of the top surface and the bottom surface and may be disposed therebetween. The block may include a non-engaging perimeter opposite the engaging perimeter and may be disposed between the top surface and the bottom surface. The block may include a protrusion that may be extending therefrom at a boundary region between the engaging perimeter and the non-engaging perimeter. The protrusion may include a padded end configured to rest about a door frame.

The door stop also may include a plurality of magnets that may be disposed in an array along an exterior of the engaging perimeter. The door stop may include a recessed portion that may be disposed about the engaging perimeter and may be configured to rest about a hinge of a door. The recessed portion may include a semi-circular size and shape that may be configured to correspond to a semi-circular surface of a hinge. The door stop may include an engagement layer that may be disposed over the plurality of magnets and may be configured to have a higher coefficient of friction than an outer surface of the block. The engagement perimeter may include two substantially parallel surfaces, including the recessed portion, connected by a surface that may be substantially orthogonal to each. The door stop may not include any hooks, any clips, and any hangars. The plurality of magnets may consist of two magnets.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
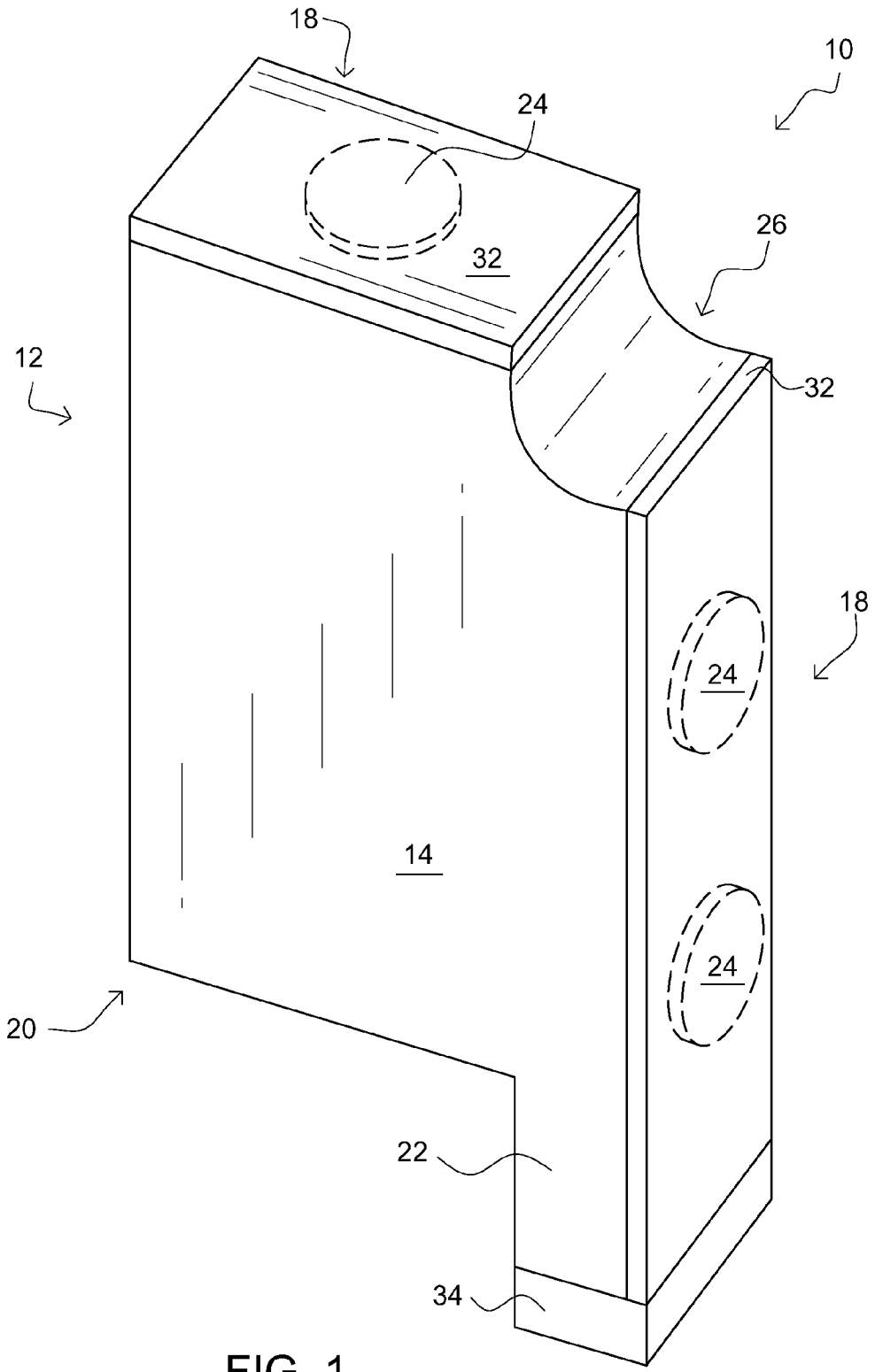
FIG. 1 is a perspective view of a door stop, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a perspective view of a door stop, according to one embodiment of the invention. There is shown a door stop 10 including a block 12

The illustrated door stop 10 is configured to support and hold a door in an open position. The door stop 10 includes a block 12 having a top surface 14 and a bottom surface. The bottom surface, although not illustrated in FIG. 1, is disposed opposite of the top surface 14. The block 12 includes an engaging perimeter 18 that is substantially orthogonal to each of the top surface 14 and the bottom surface and disposed therebetween. The engaging perimeter 18 is configured to engage a door and a door frame, thereby supporting and holding a door in an open position.

The illustrated block 12 includes a non-engaging perimeter 20 opposite the engaging perimeter 18 and is disposed between the top surface 14 and the bottom surface. The non-engaging perimeter 20 is configured to not to engage a door or a door frame while the door stop 10 is supporting and holding a door in an open position. The block 12 includes a protrusion 22 extending therefrom at a boundary region that is between the engaging perimeter 18 and the non-engaging perimeter 20. The protrusion 22 includes a padded end 34 configured to rest about a door frame. The protrusion 22 advantageously interfaces with the frame of the door to lock the door stop in place and help to secure the door in an open position. The protrusion may be capped with an engagement layer 34 that may be of a material different from the main material of the block and such a material may include but is not limited to: friction enhancing materials, rubbers, plastics, metals, magnets, materials having a textured surface configured to enhance coupling between the door stop and frame, and the like and combinations thereof.

Figure 2:
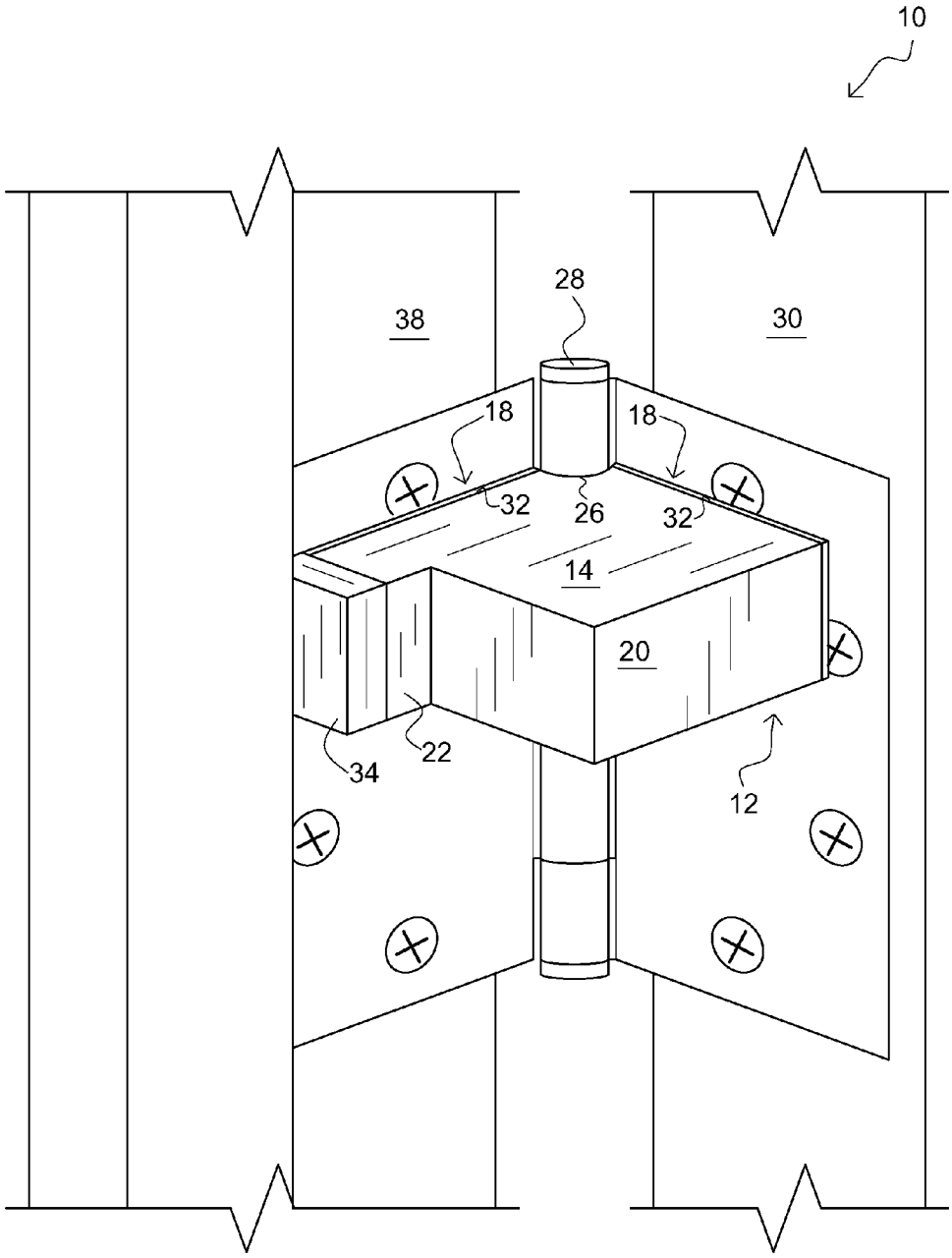
FIG. 2 is a perspective view of a door stop in use, according to one embodiment of the invention.

Looking at FIGS. 1 and 2, the illustrated engaging perimeter is substantially orthogonal to each of the top surface and the bottom surface and is disposed therebetween. The illustrated engaging perimeter includes a first engaging surface (the top most surface illustrated in FIG. 1), a second engaging surface 26 adjacent to the first engaging surface and curved in a concave manner such that it engages with a cylinder of a hinge when in operation, a third engaging surface (the rightmost surface illustrated in FIG. 1) orthogonal to the first engaging surface and adjacent to the second engaging surface, and a fourth engaging surface (the surface tagged by element number 34 in FIG. 2) adjacent to and orthogonal to the third engaging surface and distal to the second engaging surface . The illustrated non-engaging perimeter is opposite the engaging perimeter and is disposed between the top surface and the bottom surface the non-engaging perimeter including a first non-engaging surface (the surface tagged by element number 22 of FIG. 2) that is orthogonal to the fourth engaging surface and substantially parallel to the third engaging surface, thereby forming a protrusion, and there is also illustrated a second non-engaging surface orthogonal to the first non-engaging surface and adjacent to the first non-engaging surface opposite from the fourth engaging surface.

The illustrated door stop 10 includes a plurality of magnets 24 disposed in an array along an exterior of the engaging perimeter 18. The illustrated magnets are discs of magnetic material embedded and/or recessed in an engagement layer. Such discs may extend beyond the layer, be coplanar with the layer and/or may be covered by a portion of the engagement layer. Such magnets may include a portion of ferromagnetic material such as but not limited to ceramic magnets, rare-earth magnets, ferrite magnets, alnico magnets, injection molded magnets, and the like and combinations thereof. There may be a pair of magnets or sets of magnets, as illustrated, along one or more edges of the door stop, such that pivotal motion of the door stop is prevented as may be the case with only a single magnet disposed near one edge.

The illustrated door stop 10 includes a recessed portion 26 disposed about the engaging perimeter 18 and configured to rest about a hinge of a door. The recessed portion 26 is of a semi-circular size and shape configured to correspond to a semi-circular surface of a hinge barrel. Accordingly, the door stop may be mated in close alignment with a hinge without being obstructed by the hinge barrel.

The illustrated door stop 10 includes an engagement layer 32 coupled to the engaging perimeter 18 and configured to be disposed over the plurality of magnets 24. The engagement layer 32 is configured to have a higher coefficient of friction than an outer surface of the block 12. The engagement perimeter 18 includes two substantially parallel surfaces, including the recessed portion 26, connected by a surface that is substantially orthogonal to each. The door stop 10 does not include any hooks, any clips, and any hangars. The illustrated engagement layer 32 may include a layer of material having a higher effective coefficient of friction than the rest of the block. Such a layer may include one or more of the following materials in one or more layers: rubber, high friction plastic, adhesive, gecko-like material (nested nanotubes, generally carbon) such as but not limited to the product known as Geckskin created by the University of Massachusetts Amherst, polydimethylsiloxane (PDMS), satae (bristles that increase grip), silicone, magnets, and/or "stealth rubber" produced by Five Ten USA of Redlands, Calif. and Stealth Rubber of Redlands, Calif. The illustrated engagement layer 32 may extend fully or partially along one or more of the illustrated surfaces of the block that contact the hinge and/or the door, including but not limited to the protrusion 22.

In one embodiment, there is a door stop that operates on the hinge instead of on the frame of the door so that it doesn't damage the door and so that people don't have to bend down to use it. It may include a generally square block that might be plastic. There is soft plastic/rubber or otherwise friction enhancing strip to keep the block from slipping on the metal of the hinge. In addition, the block includes a plurality of magnets configured to support and secure the block to the interior metal portion of the hinge. The strip works like the sole of a sport shoes to give the block grip and cushion. There may be one or more magnets, or the like about the perimeter of the block that may advantageously assist in coupling the block to a hinge/door.

In operation, the user opens the door and stands near the interior angle of the hinge of the door (the interior angle is the smaller angle when the door is opened a small amount). The user opens the door sufficiently to allow the block member of the door stop to be wedged into the interior angle of the hinge, adjacent to and abutting both of the hinge plates of the hinge. The longer side of the block is generally abutting the hinge plate that is coupled to the door, while the shorter side is generally placed abutting the hinge plate coupled to the door frame. The plurality of magnets are configured to secure and support the block in place in between the interior portion of the hinge. The door is allowed to close up against the block and the friction enhancing strip of the block grips the hinge plate coupled to the door to keep the block in place, laterally. Thus positioned, the door stop prevents further closing of the door, reduces the amount of "give" that door stops typically allow in doors by friction fitting to the same, and applying pressure against the hinge of the door, instead of directly to the door. When removed, the plurality of magnets are uncoupled or slid off the interior portion of the hinge by applying pressure to wither the top surface or the bottom surface of the block.

FIG. 2 is a perspective view of a door stop in use, according to one embodiment of the invention. There is shown a door stop 10 disposed between a door 30 and a door frame 38 including a block 12 secured to a hinge 28.

The illustrated door stop 10 is configured to hold a door in an open position. The door stop 10 includes a block 12 having a top surface 14 and a bottom surface. The block includes an engaging perimeter 18 that is substantially orthogonal to each of the top surface 14 and the bottom surface and is disposed therebetween. The illustrated engaging perimeter 18 is configured to engage an interior of a hinge 28 that is coupling a door 30 and a door frame 38. The engaging perimeter 18 is configured to engage both sides of the interior of the hinge 28. The engaging perimeter 18 is configured to rest up against the interior of the hinge 28, thereby supporting and holding the door 30 in an open position.

The illustrated block 12 includes a non-engaging perimeter 20 opposite the engaging perimeter 18 and disposed between the top surface 14 and the bottom surface. The block 12 includes a protrusion 22 extending therefrom at a boundary region between the engaging perimeter 18 and the non-engaging perimeter 20. The protrusion 22 includes a padded end 34 configured to rest about a door frame 38. The door stop 10 includes a plurality of magnets disposed in an array along an exterior of the engaging perimeter 18. The door stop 10 includes a recessed portion 26 disposed about the engaging perimeter 18 and configured to rest about a hinge 28 of a door 30. The recessed portion 26 include a semi-circular size and shape that is configured to correspond to a semi-circular surface of the hinge 28.

The illustrated door stop 10 includes an engagement layer 32 coupled to the engagement perimeter and configured to be disposed over the plurality of magnets. The engagement layer 32 is configured to have a higher coefficient of friction than an outer surface of the block 12. The illustrated door stop 10 does not include any hooks, any clips, and any hangars.

In operation of one embodiment of the invention, there is a door opened to dispose an interior of a door hinge. A user places the door stop into a door frame, wherein an engaging perimeter rests up against an interior side of the door hinge and the plurality of magnets secure thereto. The engaging perimeter is in contact with both the interior of the door hinge, and also with the interior of the door frame hinge. The user releases the door and the door is supported and held in place by the door stop.

Figure 3:
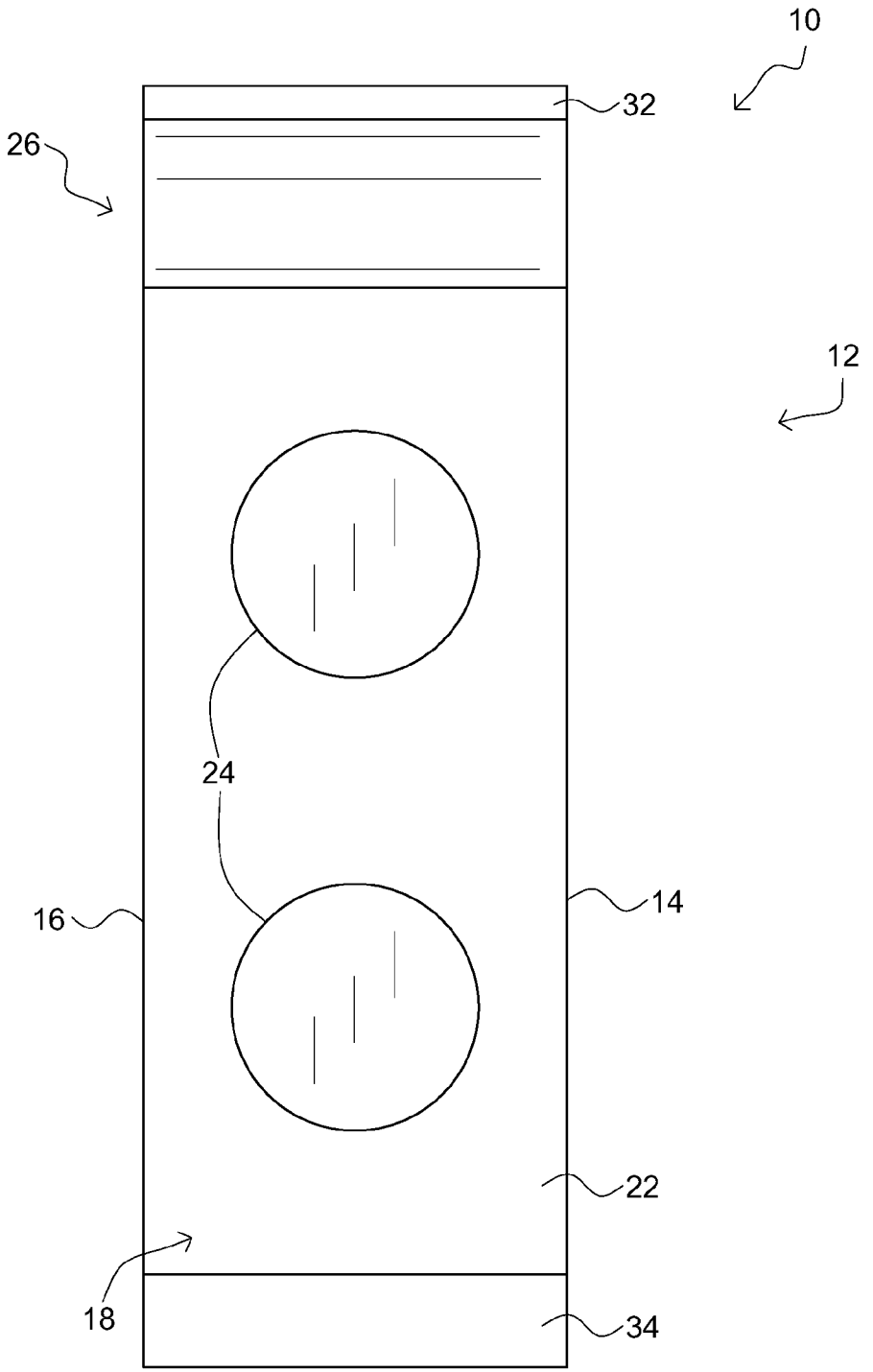
FIG. 3 is a front elevational view of a door stop, according to one embodiment of the invention.

FIG. 3 is a front elevational view of a door stop, according to one embodiment of the invention. There is shown a door stop 10 including a block 12.

The illustrated door stop 10 includes a block 12 having a top surface 14 and a bottom surface 16. The block 12 includes an engaging perimeter 18 that is substantially orthogonal to each of the top surface 14 and the bottom surface 16 and is disposed therebetween. The block 12 includes a non-engaging perimeter opposite of the engaging perimeter 18 and is disposed between the top surface 14 and the bottom surface 16. The block 12 includes a protrusion 22 extending therefrom at a boundary region that is between the engaging perimeter 18 and the non-engaging perimeter. The protrusion includes a padded end 34 configured to rest about a door frame.

The illustrated door stop 10 includes a plurality of magnets 24 disposed in an array along an exterior of the engaging perimeter 18. The door stop 10 includes a recessed portion 26 disposed about the engaging perimeter 18 and configured to rest about a hinge of a door. The recessed portion 26 includes a semi-circular size and shape that is configured to correspond to a semi-circular surface of a hinge. The door stop 10 includes an engagement layer 32 coupled to the engagement perimeter 18 and is configured to be disposed over the plurality of magnets 24. The engagement layer is configured to have a higher coefficient of friction than an outer surface of the block 12. The plurality of magnets 24 consists of two magnets.

Figure 4:
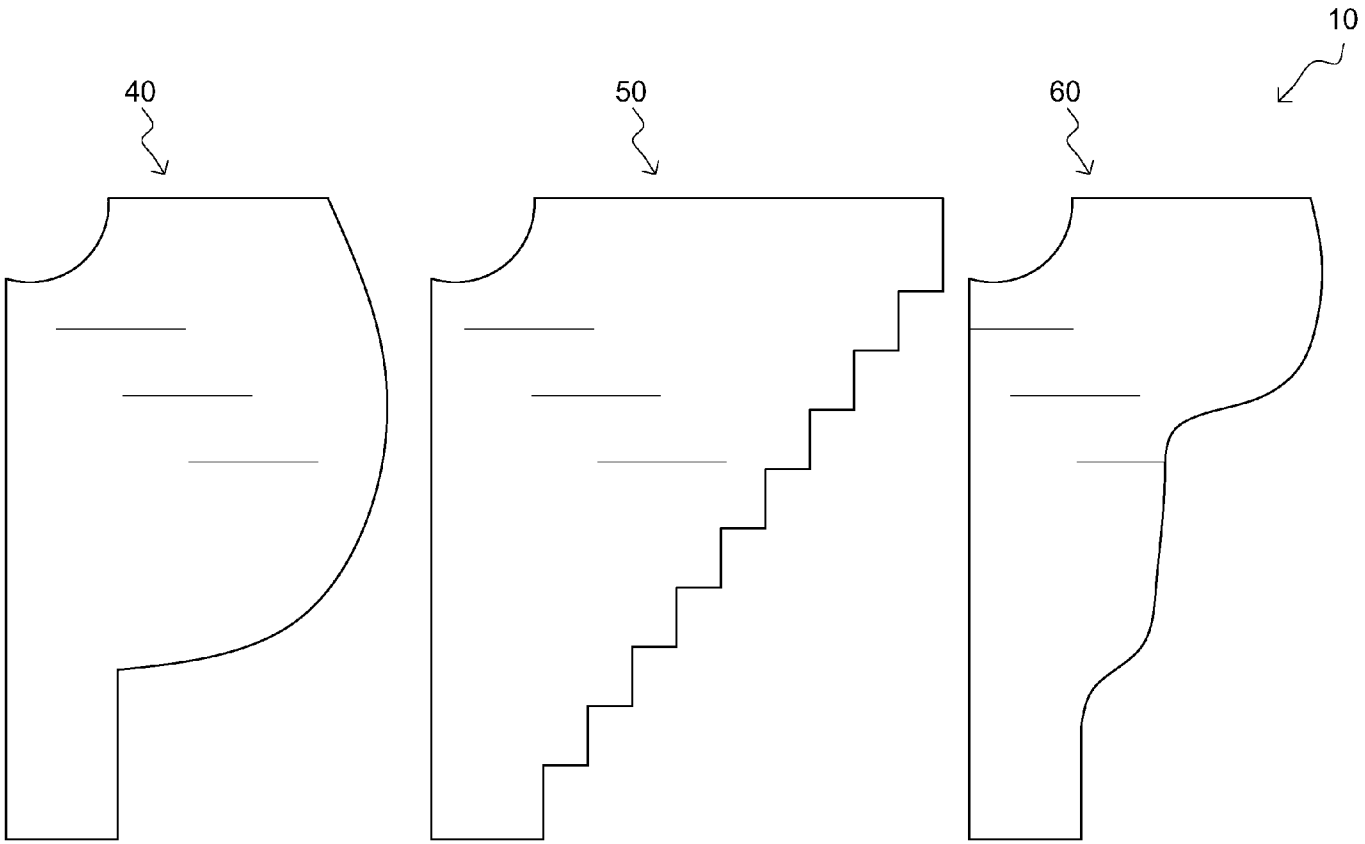
FIG. 4 is a side elevational view of a plurality of door stop design configurations, according to one embodiment of the invention.

FIG. 4 is a side elevational view of a plurality of door stop design configurations, according to one embodiment of the invention. There is shown a plurality of door stop design configurations wherein the non-engaging perimeter is of varying shapes.

The illustrated door stops 10 are configured to support and hold a door in an open position. The illustrated door stops 10 each include an engaging perimeter that are substantially similar. The illustrated door stops 10 each include different non-engaging perimeters that vary in design configurations, but are still configured to perform its intended function.

The illustrated door stops 10 include a semi-circular design configuration 40 configured to provide a rounded profile design configuration but is still configured to perform its intended function.

The illustrated door stops 10 include a stepped design configuration 50 configured to provide a stair step profile design configuration but is still configured to perform its intended function.

The illustrated door stops 10 include an oblong design configuration 60 configured to provide an irregular curve profile design configuration but still configured to perform its intended function.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the figures illustrate a particular thickness of the block, it is understood that the thickness of the block may vary for aesthetic and/or utilitarian purposes.

Additionally, although the figures illustrate particular shapes of the block, it is understood that the usable shapes are plethoric and may include regions that are rectangular, oval, circular, elliptical, irregular, polygonal, and the like and combinations thereof.

It is also envisioned that the illustrated magnets may be of shapes, configurations, and positions other than those illustrated in the drawings, such as but not limited to strip magnets, square magnets, irregularly shaped magnets, and the like and combinations thereof as well as two-dimensional arrays of smaller magnets, longer arrays of magnets than that illustrated, irregular positioning of the same, and the like and combinations thereof.

It is expected that there could be numerous variations of the aesthetic design of this invention.

Finally, it is envisioned that the components of the device may be constructed of a variety of materials including but not limited to rubber, plastic, metal, wood, fibers, woven fibers, polymers, resins, ceramics, and the like and combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A door stop, comprising:

a) a block, including:

a1) a top surface;

a2) a bottom surface, spaced from the top surface by a first distance representing a height of the block;

a3) a first surface orthogonal to each of the top surface and bottom surface and having a maximum width that is greater than the height of the block;

a4) a second surface adjacent to the first engaging surface orthogonal to each of the top surface and bottom surface and curved in a concave manner such that it engages with a cylinder of a hinge when in operation;

a5) a third surface orthogonal to each of the top surface, the bottom surface, and the first surface, having a maximum width that is greater than the height of the block, and adjacent to the second surface;

a6) a fourth surface adjacent to and orthogonal to each of the top surface, the bottom surface, and the third surface and distal to the second surface, wherein the fourth engaging surface has a maximum width that is smaller than the maximum width of the first surface;

a7) a fifth surface adjacent to and extending orthogonally from each of the top surface, the bottom surface, and the fourth surface, and distal to the third surface, wherein the fifth surface has a maximum width that is smaller than the maximum width of the third surface;

a8) a sixth surface adjacent to and extending orthogonally from each of the top surface and the bottom surface, adjacent to the fifth surface and distal to the fourth surface; and a9) a seventh surface adjacent to and orthogonally from each of the top surface, the bottom surface, the first surface and the sixth surface, distal to the fourth surface, parallel to the third surface and having a maximum width that is smaller than the maximum width of the third surface; and b) a magnet disposed inside the first surface and a magnet disposed inside the third surface.

2. The door stop of claim 1, further comprising an engagement layer disposed over the first surface and over the second surface and configured to have a higher coefficient of friction than an outer surface of the block.

3. The door stop of claim 1, wherein the seventh surface includes a padded end configured to rest about a door frame.

4. The door stop of claim 1, wherein the door stop does not include any hooks, any clips, and any hangars.

5. A door stop, comprising:

a) a block, including:

a1) a top surface;

a2) a bottom surface, spaced from the top surface by a first distance representing a height of the block;

a3) a perimeter substantially orthogonal to each of the top surface and the bottom surface and disposed therebetween, the perimeter including a first surface having a maximum width greater than the height of the block, a second surface adjacent to the first surface and curved in a concave manner such that it engages with a cylinder of a hinge when in operation, a third surface orthogonal to the first surface, having a maximum width that is greater than the height of the block, and adjacent to the second surface, and a fourth surface adjacent to and orthogonal to the third surface and distal to the second surface, a fourth surface extending orthogonally from the third surface, parallel to the first surface, and having a maximum width smaller than the maximum width of the first surface, a fifth surface that is concave, adjacent to the fourth surface, and opposite the second surface, and a sixth surface that is adjacent to each of the first surface and fifth surface, opposite and parallel to the third surface and having a maximum width smaller than the maximum width of the third surface; and b) a plurality of magnets disposed in an array along an exterior of the perimeter.

6. The door stop of claim 5, wherein the perimeter further comprises an engagement layer disposed over the plurality of magnets and is configured to have a higher coefficient of friction than an outer surface of the block.

7. The door stop of claim 6, wherein the sixth surface includes a padded end configured to rest about a door frame.

8. The door stop of claim 7, wherein the plurality of magnets consists of two magnets.

9. A door stop, consisting of:

a) a block, including:

a1) a top surface;

a2) a bottom surface, spaced from the top surface by a first distance representing a height of the block;

a3) a perimeter substantially orthogonal to each of the top surface and the bottom surface and disposed therebetween, the perimeter including a first surface having a maximum width greater than the height of the block, a second surface adjacent to the first surface and curved in a concave manner such that it engages with a cylinder of a hinge when in operation, a third surface orthogonal to the first surface, having a maximum width that is greater than the height of the block, and adjacent to the second surface, and a fourth surface adjacent to and orthogonal to the third surface and distal to the second surface, a fourth surface extending orthogonally from the third surface, parallel to the first surface, and having a maximum width smaller than the maximum width of the first surface, a fifth surface that is concave, adjacent to the fourth surface, and opposite the second surface, and a sixth surface that is adjacent to each of the first surface and fifth surface, opposite and parallel to the third surface and having a maximum width smaller than the maximum width of the third surface; and b) a plurality of magnets disposed in an array along an exterior of the perimeter; and c) an engagement layer disposed over the plurality of magnets and configured to have a higher coefficient of friction than an outer surface of the block.

10. The door stop of claim 9, wherein the recessed portion includes a semi-circular size and shape configured to correspond to a semi-circular surface of a hinge.

11. The door stop of claim 10, wherein the sixth surface includes a padded end configured to rest about a door frame.

12. The door stop of claim 11, wherein the door stop does not include any hooks, any clips, and any hangars.

13. The door stop of claim 12, wherein the plurality of magnets consists of two magnets.

* * * * *